United States Patent [19]

Garvin

[11] 4,083,314

[45] Apr. 11, 1978

[54] WALL DEPOSITORY

[75] Inventor: George R. Garvin, River Forest, Ill.

[73] Assignee: Sam Garvin & Company, Chicago, Ill.

[21] Appl. No.: 683,641

[22] Filed: May 6, 1976

[51] Int. Cl.[2] ..... E05G 1/00

[52] U.S. Cl. ..... 109/50; 109/54; 312/204; 312/242

[58] Field of Search ..... 109/23, 50, 52, 54, 109/58, 59; 220/3.5, 3.8; 248/27.1, 27.3, DIG. 6

[56] References Cited

U.S. PATENT DOCUMENTS

| | | | |
|---|---|---|---|
| 916,436 | 3/1909 | Greenfield | 248/DIG. 6 |
| 968,536 | 8/1910 | Brucklacher | 109/50 |
| 1,416,179 | 5/1922 | Ehrlich | 109/59 |
| 2,139,909 | 12/1938 | Park | 109/52 X |
| 3,386,393 | 6/1968 | Peterson et al. | 109/50 |
| 3,717,112 | 2/1973 | Welty | 109/23 |
| 3,999,493 | 12/1976 | Gulya | 109/23 R |

*Primary Examiner*—Paul R. Gilliam
*Assistant Examiner*—David H. Corbin
*Attorney, Agent, or Firm*—Fitch, Even, Tabin & Luedeka

[57] ABSTRACT

A miniature wall depository is disclosed having a receptacle box mounted substantially behind a wall surface. A depository container for holding valuables is receivable within the receptacle box and means intermediate of the depository container and the receptacle box frictionally grip the depository container to hold it in place while permitting easy insertion and withdrawal. A concealing means is carried by the depository container to cover the container and the receptacle box to disguise and hide the wall depository.

9 Claims, 4 Drawing Figures

WALL DEPOSITORY

The present invention is generally directed to wall depositories and is more specifically concerned with miniature concealed wall depositories or safes for the safekeeping of small valuables without locks or combinations. It is well known, for example, that small quantities of valuables may be hidden within a wall recess, which is disguised by a cover such as a simulated wall receptacle plate. However, a simple wall recess or recessed container that opens through the wall may be unsatisfactory, for the valuables must be stuffed into the recessed space and then a cover plate mounted thereover to hide the valuables. When the cover is removed, the valuables simply spill out of the recessed space. And in some wall safes the cover plate is mounted on a recessed container by a complicated hinge arrangement which may require a large hole in the wall for mounting the container. Also, some depositories that employed an electric receptacle cover for disguise, actually used a complete electrical receptacle, which was apparently functional, except for electrical connections. This, of course, results in a more expensive depository and reduces the space within the recess for containing valuables.

Accordingly, it is an object of the present invention to provide a new and improved wall depository which does not suffer from the disadvantages of "prior art" depositories. It is a further object of the present invention to provide a minature wall depository with a separate valuable holding container and which is easy to install and does not contain complicated or sophisticated concealing apparatus. Another object of the invention is to provide a miniature wall depository as described above which may be relatively inexpensively manufactured and easily installed.

In meeting the above objects, the present invention provides a wall depository comprising a receptacle box that may be mounted behind a wall surface, a depository container for holding valuables which is slidably receivable within the receptacle box and a concealing plate which is carried by the depository container to cover and disguise the wall depository when the depository container is inserted into the receptacle box. The depository container is frictionally held within the receptacle box by means provided internally of the receptacle box to frictionally grip the walls of the depository container, permitting easy insertion and withdrawal of the container.

Additional objects and advantages of the invention are more particularly set forth in the following detailed description and the accompanying drawings of which:

Figure 3:
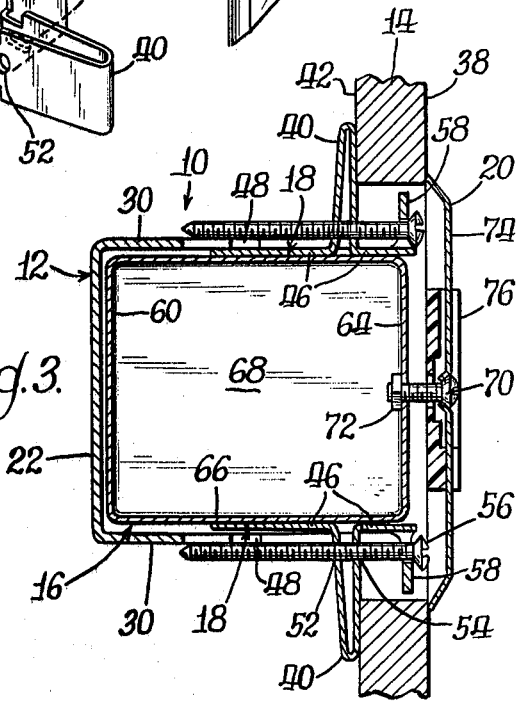
FIG. 3 is a horizontal sectional view of a wall depository taken along line 3—3 of FIG. 2.

Turning now to a detailed description of the present invention, it is generally embodied in a miniature wall depository 10 which may be used to conceal and hide small quantities of valuables. In accordance with the present invention a receptacle box 12 is mounted substantially behind a wall 14. A depository container 16 is slidably receivable within the receptacle box and means intermediate of the receptacle box and the depository container frictionally grip the side walls of the container, as best seen in FIG. 3, in and around the point designated 18, to hold it in place within the receptacle box. The frictional gripping also serves to permit easy insertion and withdrawal of the depository box for access to the valuables contained therein. A cover plate 20 for concealing the wall depository is carried by the depository container and covers the container and the receptacle box when the container is inserted into the box.

Figure 1:
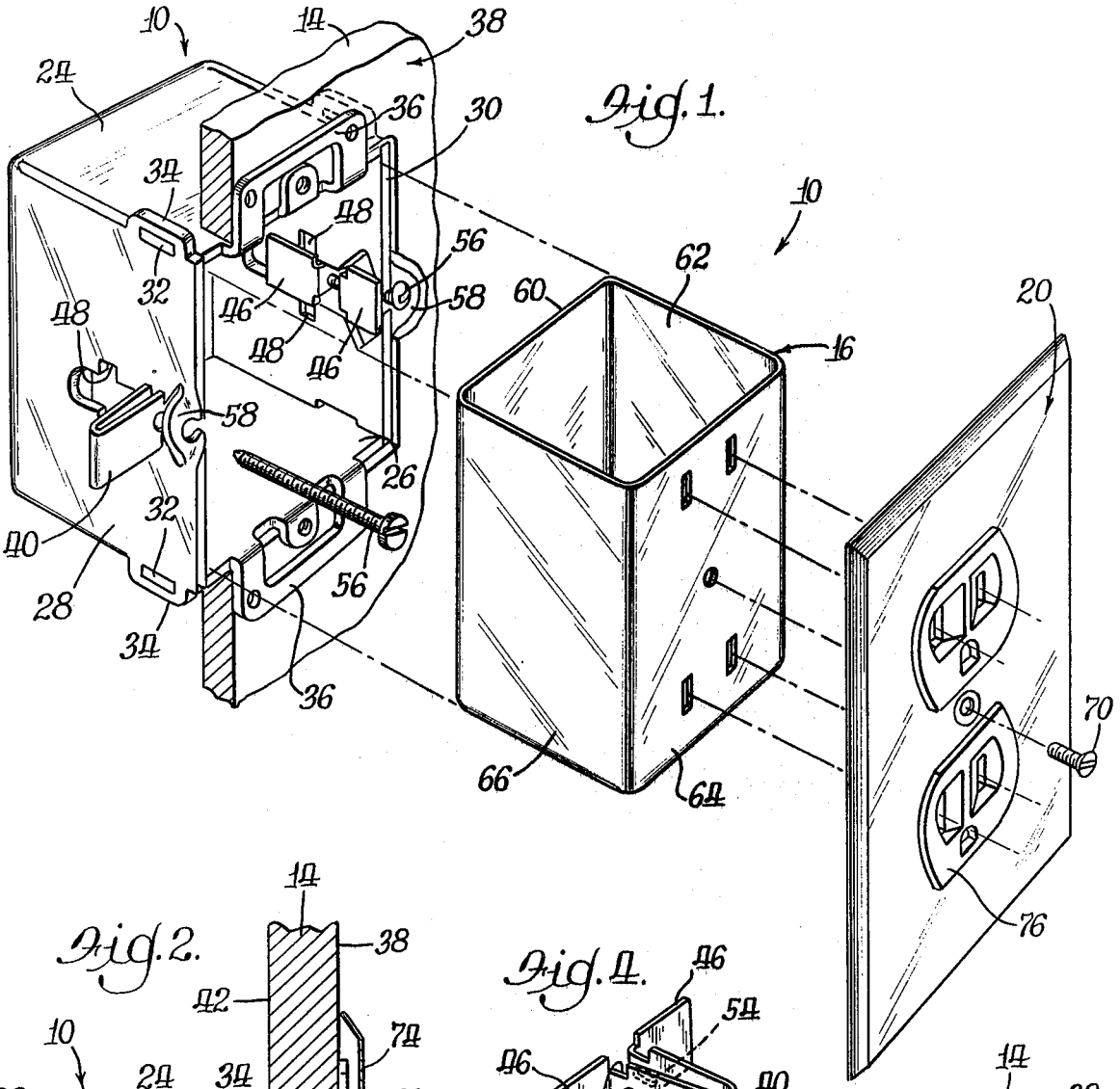
FIG. 1 is an exploded view of a wall depository embodying the present invention.

For receiving and holding the depository container, the wall receptacle box 12 is preferably of a type and construction often used in routine electrical installations. The receptacle box is usually stamped from galvanized steel or aluminum sheet metal and, as shown in an upright configuration in FIG. 1, includes a back wall 22, top and bottom walls 24 and 26, respectively, and side walls 28 and 30. The back wall 22 is generally rectangular and is of one piece construction with the top and bottom and side walls which are bent at substantially a right angle with the back wall to form a hollow receptacle box with a frontal opening for receiving the depository container 16. To hold the walls together, the top and bottom walls 22 and 24 include tabs 32 extending from their side edges which are press-fit into slotted nubs 34 on the top and bottom edges of the side walls.

The wall 14 behind which the receptacle box will be mounted may be of any construction, although wallboard, plaster or plaster and lathe are typical types of walls in which it may be mounted. To prevent the receptacle box from being pushed completely behind the wall when it is being installed, the top and bottom sides 24 and 26 of the box each includes a laterally extending flange 36 to abut an outer surface 38 of the wall 14.

Figure 4:
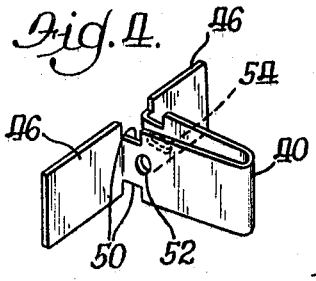
FIG. 4 is a perspective view of a retaining ear which may be used to hold the receptacle box in place behind a wall surface and also to frictionally grip the walls of the depository container which is insertable into the receptacle box.

The receptacle box 12 is actually held in place behind the wall 14 by a pair of retaining ears 40 which extend through the side walls 28 and 30 of the receptacle box and are drawn against a backside 42 of the wall 14, firmly sandwiching the wall between the retaining ears and the flanges 36. As may be more easily seen in FIG. 4, the retaining ears 40 are preferably formed by bending a sheet metal strip of uniform width into a generally U-shaped configuration and by further bending both ends of the strip outwardly to form a pair of opposed feet or wings 46. As noted before, the U-shaped portion of the ears 40 extend through the sides of the receptacle box 12 to abut the backside of the wall 14. The feet or wings 46 of each ear remain inside the receptacle box and are generally parallel to and may be spaced slightly from the inner surface of the side wall through which the ear extends.

To permit the ear 40 to be drawn tightly against the backside 42 of the wall 14, a horizontal slot is provided in each side walls 28 and 30 of the receptacle box 12 within which the ear 40 slides. Except for a pair of niches 48 in the rear portion of the slot, through which the U-shaped ear is inserted, the slot is narrower than the width of the ear 40. At the junction of the U-shaped portion and the wings, the ear is grooved, as designated at 50, to slide along the horizontal slot in the receptacle box. The clip may then be drawn against the back side 42 of the wall 14, the edges of the horizontal slot in the receptacle box residing in the grooves 50 provided at the junction of the U-shaped portion and wing portions of ear 40.

To pull or draw the ear 40 against the back side 42 of the wall 14, openings 52 and 54 are provided in the ear 40 for insertion of a screw 56. The screw extends through a flange 58 on each side of the receptacle box and against which the head of the screw may abut. By turning the screw the ear may be pulled forward, toward the back side 42 of the wall 14. The screw 56 actually engages the rearward opening 52 of the ear. The front opening 54 is elongated, as may be seen in FIG. 4, to allow for shifting and additional bending of the ear as it is tightened against the back side of the wall. The elongation may also provide an allowance for the wing portions 46 of the ear to shift slightly inwardly of the receptacle box wall upon tightening of the screw 56, thereby providing a small gap between at least one of the wings and the interior surface of the sidewalls 28 and 30 so as to provide a spring-like frictional engagement with the depository container 16 when it is inserted into the receptacle box.

It can thus be seen from the description above that the receptacle box 12 is of very simple construction - it is equally simple to install. After choosing the particular wall in which to install the wall depoitory, the wall is then sounded or test drilled to assure that there are no wall studs or other obstructions behind the wall that might interfere with installation of the safe. A hole of approximately the same size as the receptacle box 12 is then cut into the wall and the box is then inserted until the flanges 36 abut the wall surface 38. The retaining ears 40 are next pushed from the inside of the receptacle box through the niches 48 in the horizontal slots in the sides 28 and 30 of the box, and the grooves 50 in the ears are aligned with the edges of the slot. The screws 56 may then be inserted through the flanges 58 and the elongated holes 54 of the ears until they engage the rearward holes 52 in the retaining ears. The screws may then be turned, drawing the ears 40 forward until each abuts the back side 42 of the wall 14, and thereby snugly secures the receptacle box in place, ready to receive the depository container 16.

The depository container 16 is preferably of one-piece, stamped construction from sheet steel or aluminum. If steel, it may be galvanized to prevent rusting. More specifically, the depository container includes four vertical sidewalls 60, 62, 64 and 66 and a bottom wall 68. The top of the container is preferably open for adding or removing valuables from the container.

To hold the depository container in place within the receptacle box 12 while also permitting simple and easy insertion and withdrawal, the depository container is appropriately sized for the vertical sidewalls 62 and 66 to frictionally engage the wing or feet portions 46 of the ears 40, preferably in the area on each side of the point earlier indicated by the numeral 18 in FIG. 3. The engagement between the depository container and the wings 46 may be without give or compensation in the wings or as described earlier, the wings may be spaced from the inner surface of the sidewall of the receptacle box due to tightening of the screw 56, to form a butterfly-type spring which compresses and gives as the depository container is inserted. This is better seen in FIG. 3. This construction retains the depository container within the receptacle box by frictional engagement and thereby permits relatively simple insertion and withdrawal.

Figure 2:
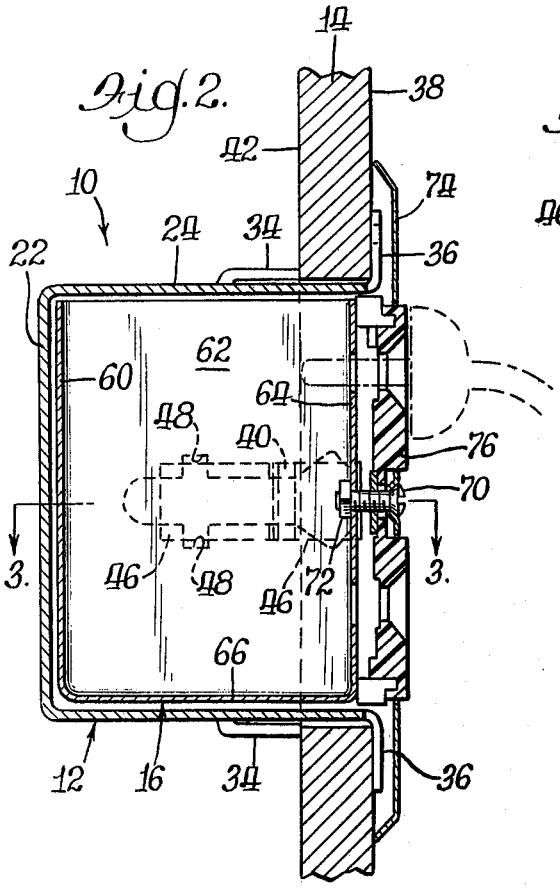
FIG. 2 is a vertical sectional view of the wall depository of FIG. 1 in fully assembled position.

The concealing means 20 shown in a preferred embodiment is a simulated duplex electrical receptacle cover. The cover 20 is attached to the vertical sidewall 64 of the depository container 16 by a screw 70 and nut 72. The cover includes a plate portion 74 and a simulated receptacle portion 76 secured within a pair of spaced holes within the plate. The plate serves to overlap the flanges 36 and 58 of the receptacle box 12 and to abut the wall surface 38 to conceal the wall depository and to disguise it as a typical electrical wall outlet when the depository container is positioned within the receptacle box. The simulated electrical receptacle 76 are preferably of plastic construction and, as can best be seen in FIGS. 2 and 3, are not the complete receptacle but simply the plastic portion which one would see looking at a typical wall outlet - there are no electrical connections or contact members to receive an electrical charge to make the outlet functional. To better disguise the wall depository while also providing a means for withdrawing the depository container, portions of the vertical sidewall 64 of the depository container which are behind the openings in the simulated receptacle 76 are removed to provide four openings substantially corresponding to the slots in the simulated receptacles. This has several advantages, it removes any metallic reflection which may call attention to the fact that the wall receptacle is merely a simulation, it permits electrical plug to be inserted into the receptacle to further simulate a working electrical receptacle (Phantom in FIG. 2) and it also permits the depository container to be easily withdrawn, by inserting an ordinary household or automobile key into one of the slots of the simulated receptacle, turning the key slightly to engage the slot in the receptacle or the slot in depository container and pulling outward to remove the depository container which is held in the receptacle box by frictional engagement with the wing portions 46 of the ears 40.

It can therefore be seen that the present invention provides a convenient and simple wall depository for containing small quantities of valuables in a concealed and hidden position. The receptacle box 12 is of typical construction for electrical installation, and the ears 40 which function to hold the receptacle box firmly behind the wall also include wing portions 46 interior of the sidewalls of the receptacle box which may form butterfly-type springs to frictionally engage the sidewalls of the depository container 16 when it is inserted within the receptacle box. The depository container is enclosed except for a top opening and into which small quantities of valuables may be deposited. The depository container is also attached to a concealing cover, a simulated wall receptacle, in the preferred embodiment which overlies the receptacle box, including the flanges 36 and 58, and the depository container 16 to conceal and hide the wall depository. As is best seen in FIG. 3, the wing portions of the ear 40 engage the sidewalls of the depository container to hold it in place yet also allow the depository container to be simply removed by either gripping the edge of the receptacle cover and pulling, or by inserting a key or other rigid instrument into the receptacle slot and pulling. Although the present invention has been described in terms of a preferred embodiment, various modifications, some immediately apparent and others apparent only after some study, may be made without departing from the present invention.

Various features of the present invention are set forth in the following claims.

What is claimed is:

1. A wall depository comprising a receptacle box, means for mounting said receptacle box substantially behind an opening in a wall surface, a depository container for holding valuables, opening means in said receptacle box for receiving said depository container therewithin through said wall opening, concealing means carried by said depository container to disguise said wall depository, said mounting means including spring means interior of said receptacle box and disposed to frictionally engage said depository container therewithin to hold within said receptacle box and further including a retaining means extending through said receptacle box to behind said wall surface for holding said receptacle box therebehind, said concealing cover means being carried by said depository container and disposed to overlap said wall surface to disguise and hide said wall depository when said depository container is received in said receptacle box.

2. A wall depository in accordance with claim 1 in which said spring means is a butterfly spring carried on at least one wall of said receptacle box.

3. A wall depository in accordance with claim 2 in which said receptacle box includes a flange means disposed against said wall surface, said butterfly spring comprising the end portions of a metallic strip, and said retaining means comprising the portion of said strip between said end portions.

4. A wall depository in accordance with claim 1 in which said concealing means is a cover only simulating a duplex electric wall receptacle.

5. A wall depository comprising a receptacle box, a means for mounting said receptacle box substantially behind an opening in a wall surface, a depository container for holding valuables, opening means in said receptacle box for receiving said depository container within said receptacle box through said wall opening, concealing means carried by said depository container for disguising said wall depository, said mounding means including a strip having an intermediate portion and end portions, said receptacle box including a slotted side wall, said intermediate portion of said strip being disposed through said slot to abut a back side of said wall surface, said end portions being disposed interiorly of said receptacle wall to frictionally engage said depository container, said concealing means serving to cover said depository container and said receptacle box to conceal and hide said wall depository when said depository container is received within said receptacle box.

6. A wall depository in accordance with claim 5 in which said depository container includes four side walls defining a top opening and a bottom opening, said bottom opening being closed by a bottom wall.

7. A wall depository in accordance with claim 6 in which said concealing means is a simulated-only duplex electric receptacle cover, said cover being attached to a side wall of said depository container, portions of said side wall behind said receptacle cover being removed to permit insertion of a key to withdraw said depository container.

8. A wall depository in accordance with claim 5 in which at least one of said end portions of said strip is spaced from the inside surface of said slotted side wall to provide a spring-type engagement with said depository container.

9. A wall depository comprising a receptacle box for mounting substantially behind a wall surface, said receptacle box having a pair of sidewalls, a top wall and a bottom wall defining a frontal opening therein, a depository container slidably receivable within said receptacle box through said frontal opening, a simulated-only duplex electric receptacle cover carried by said depository container for disguising said concealing said wall depository, opening means in said sidewalls of said receptacle box defining slotted passageways therethrough, sheet metal strips disposed through said slotted passageways in sidewalls of said receptacle box and movable along said passageways to abut a backside of said wall surface, said receptacle box, including flange means to abut said wall surface for securing said wall surface between said flange means and said sheet metal strips, end portions of said strips disposed within said receptacle box intermediate of said sidewall and said depository container to frictionally grip said depository container, said depository container further having opening means behind said simulated duplex receptacle cover to permit insertion of a key to withdraw said depository container.

* * * * *